US007907159B2

(12) United States Patent
Matsuo et al.

(10) Patent No.: US 7,907,159 B2
(45) Date of Patent: Mar. 15, 2011

(54) THERMAL PRINTHEAD

(75) Inventors: Masamichi Matsuo, Kyoto (JP); Koji Nishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 430 days.

(21) Appl. No.: 12/220,627

(22) Filed: Jul. 25, 2008

(65) Prior Publication Data

US 2009/0027477 A1 Jan. 29, 2009

(30) Foreign Application Priority Data

Jul. 25, 2007 (JP) ..... 2007-192841

(51) Int. Cl.
*B41J 2/335* (2006.01)

(52) U.S. Cl. ..... 347/209

(58) Field of Classification Search ..... 347/194, 347/200, 208, 209, 211
See application file for complete search history.

(56) References Cited

U.S. PATENT DOCUMENTS 5,335,002 A * 8/1994 Nagahata et al. ..... 347/209
5,532,723 A * 7/1996 Nagahata et al. ..... 347/209
5,760,813 A * 6/1998 Yamaguchi et al. ..... 347/183

FOREIGN PATENT DOCUMENTS

JP 5-221002 8/1993

* cited by examiner

*Primary Examiner* — Huan H Tran
(74) *Attorney, Agent, or Firm* — Hamre, Schumann, Mueller & Larson, P.C.

(57) ABSTRACT

A thermal printhead includes a substrate, a heating resistor formed on the substrate, a drive IC for controlling power application to the heating resistor, and a thermistor mounted on the substrate and including first and second terminals. The drive IC includes a print execution signal terminal for activation of the heating resistor upon application of a voltage higher than a threshold value. The first terminal of the thermistor is connected with the print execution signal terminal.

3 Claims, 2 Drawing Sheets

THERMAL PRINTHEAD

BACKGROUND OF THE INVENTION

1. Field of the Invention

The present invention relates to a thermal printhead mounted on a thermal printer.

2. Description of the Related Art

FIG. 3 shows a conventional thermal printhead (see JP-A-H05-221002, for example). The illustrated thermal printhead X, including an elongated heating resistor 92 formed on a substrate 91, is connected with the thermal printer's control section Pr via a connector 96. The control section Pr sends signals necessary for performing the printing operation to a drive IC 93. The drive IC 93 has a strobe signal terminal 93*a*, to which a strobe signal is sent via a strobe signal terminal 96*a* of the connector 96. The strobe signal determines a duration of time for the heating resistor 92 to be energized. While the strobe signal assumes HIGH level, the drive IC 93 makes power application selectively to the heating resistor 92.

The substrate 91 is provided with a thermistor 94. The thermistor 94 is connected with the thermal printer's control section Pr via a thermistor terminal 96*b* of the connector 96. The control section Pr obtains information on the temperature of the substrate 91 based on a resistance value of the thermistor 94. If the thermistor 94 gives an extremely small resistance value (meaning that the substrate 91 is at an abnormally high temperature), the control section Pr stops sending the printing commands to the drive IC 93 in order to prevent the thermal printhead X from operating abnormally or being damaged.

However, there is still a risk that an unexpected malfunction occurs in the control section Pr, and the printing commands to the drive IC 93 fail to be stopped, even if the thermistor 94 gives an extremely small resistance value. In such a case, the thermal printhead X can be left in an abnormally heated condition for a long time.

SUMMARY OF THE INVENTION

The present invention has been proposed under the circumstances described above. It is therefore an object of the present invention to provide a thermal printhead that does not suffer an abnormally high heating condition.

According to the present invention, there is provided a thermal printhead comprising: a substrate; a heating resistor formed on the substrate; a drive IC for controlling power application to the heating resistor; and a thermistor mounted on the substrate and including a first terminal and a second terminal. The drive IC includes a print execution signal terminal for activation of the heating resistor upon application of a voltage higher than a threshold value. The first terminal of the thermistor is connected with the print execution signal terminal.

With the above arrangement, a large electric current will flow through the thermistor when the substrate becomes abnormally hot. Using this current, it is possible to cause a voltage drop for the voltage applied to the print execution signal terminal. As a result, the print execution signal terminal is supplied with a voltage which is lower than a predetermined threshold value. In this manner, it is possible to reliably terminate the printing operation when the substrate becomes abnormally hot.

Preferably, the thermal printhead of the present invention may further comprise: an external connection terminal connected with the print execution signal terminal; and a resistor including a first end and a second end. In this instance, the first end of the resistor is connected with the print execution signal terminal, while the second end of the resistor is connected with the external connection terminal. The first terminal of the thermistor is connected with a connection path extending between the first end of the resistor and the print execution signal terminal.

Preferably, the second terminal of the thermistor may be connected with a grounding line.

Other characteristics and advantages of the present invention will become clearer from the following detailed description to be made with reference to the attached drawings.

DETAILED DESCRIPTION OF THE PREFERRED EMBODIMENTS

Hereinafter, preferred embodiments of the present invention will be described specifically, with reference to the drawings.

Figure 1:
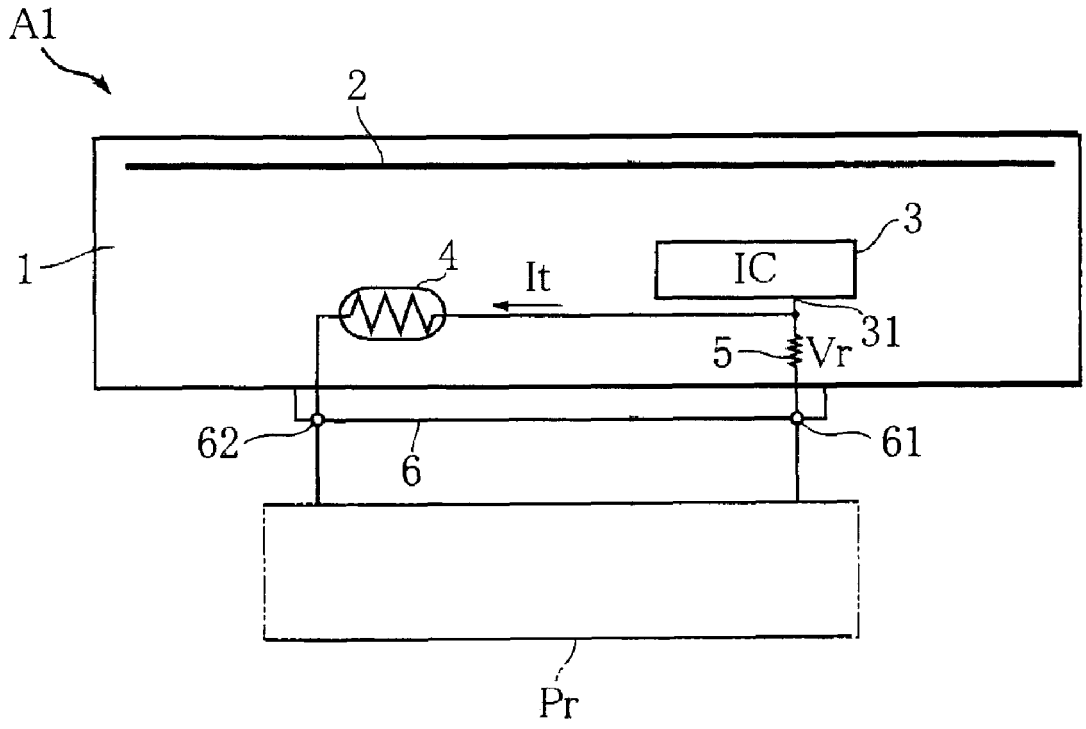
FIG. 1 illustrates a thermal printhead according to a first embodiment of the present invention.

FIG. 1 shows a thermal printhead according to a first embodiment of the present invention. The illustrated thermal printhead A1 includes a substrate 1, a heating resistor 2, a drive IC 3, a thermistor 4, a resistor 5 and a connector 6.

The substrate 1 is made of an insulating material such as ceramic, and is rectangular for example.

The heating resistor 2, elongated longitudinally of the substrate 1, is made of a resistive material such as ruthenium oxide. The heating resistor 2 is connected with a plurality of unillustrated electrodes. These electrodes are equally spaced along the heating resistor 2, allowing the divided portions (heating dots) of the heating resistor 2 to be energized selectively. The heating resistor 2 is covered by a protective layer (not shown) made of glass for example.

The drive IC 3 provides control over the printing operation through the selective power application to the heating resistor 2 via the electrodes described above. The drive IC 3 receives signals necessary for the printing operation from the control section Pr. These signals include, for example, a printing data signal, a clock signal, a latch signal and a strobe signal. Of these, the strobe signal is inputted to a strobe signal terminal 31 of the drive IC 3. If the strobe signal has a higher voltage than a predetermined threshold value and if a set of printing conditions, including the latch signal status for example, is met, the drive IC 3 executes selective power application to the heating resistor 2, i.e., to those small portions selected by the printing data signal.

The connector 6 is to establish an electrical connection between the thermal printhead A1 and the thermal printer, and includes a strobe signal terminal 61 and a grounding terminal 62 for example. The strobe signal terminal 61 is where the strobe signal is inputted from the thermal printer's control section Pr, and is connected with the strobe signal terminal 31 of the drive IC. The grounding terminal 62 is connected with a grounding line of the control section Pr.

The thermistor 4 is in close contact with the substrate 1 so that its temperature will be close to the temperature of the substrate 1. The thermistor 4 makes drastic decrease in its resistance as the temperature increases. The thermistor 4 has a terminal connected with a wire which connects the strobe signal terminal 31 of the drive IC 3 with the strobe signal terminal 61 of the connector 6. The thermistor 4 has another terminal which is connected with the grounding terminal 62 of the connector 6.

The resistor 5 is a fixed resistor, i.e. a resistor whose resistance value is substantially constant. In the present embodiment, the resistor 5 is placed in series in a wiring which connects the strobe signal terminal 31 of the drive IC 3 with the strobe signal terminal 61 of the connector 6. In this wiring, the resistor 5 is closer to the strobe signal terminal 61 than is the connecting point where one of the terminals of the thermistor 4 is connected. In a manufacturing process, the resistor 5 can be formed simultaneously with the heating resistor 2 when the heating resistor 2 is formed by printing a pattern of a resistive material.

The function of the thermal printhead A1 will be described below.

First, in a case where the temperature of the substrate 1 is within a predetermined normal temperature range, the resistance value of the thermistor 4 is extremely large. Thus, the amount of electric current It flowing through the thermistor 4 is almost zero. The strobe signal sent from the control section Pr then gets a voltage reduction by the amount of voltage Vr at the resistor 5. Since the voltage Vr in this case is within an assumed voltage range, the strobe signal which assumes HIGH level when sent from the control section Pr will remain HIGH when it enters the drive IC 3. Therefore, the drive IC 3 will follow a printing execution command from the control section Pr, and perform a printing control.

On the other hand, if the temperature of the substrate 1 becomes higher beyond the normal temperature range, the resistance value of the thermistor 4 will become extremely small. Thus, the amount of electric current It which flows through the thermistor 4 will become remarkably larger than in the case described above. Since the current It flows through the resistor 5, the voltage Vr at the resistor 5 becomes remarkably high, and as a result of voltage reduction by the amount of voltage Vr, the strobe signal becomes LOW when it enters the drive IC 3 even if it was HIGH when sent from the control section Pr. Therefore, it is possible to stop the printing regardless of the printing execution commands from the control section Pr when the temperature of the substrate 1 becomes abnormally high. Consequently, the abnormally high temperature situation will not last for a prolonged period of time.

After the temperature of the substrate 1 becomes abnormally high, the thermal printhead A1 returns to a printable state once the temperature of the substrate 1 drops down to the normal temperature range. This eliminates such a burden that the thermal printhead A1 must be replaced with a new one every time the temperature of the substrate 1 becomes high. In this aspect, the present invention is superior to such an idea of incorporating a thermal fuse as a means for avoiding an abnormally high temperature situation.

Since the thermal printhead A1 is provided with the thermistor 4 and the resistor 5, there is no need for the control section Pr of the thermal printer to have extra functions to handle the temperature abnormality. This contributes to cost reduction of the thermal printer.

The current It flows through the grounding terminal 62, and is released to the grounding line of the thermal printer. Therefore, even if the current It becomes extremely large, it is not likely that such a situation will cause an adverse influence on the thermal printhead A1 or on the thermal printer.

Figure 2:
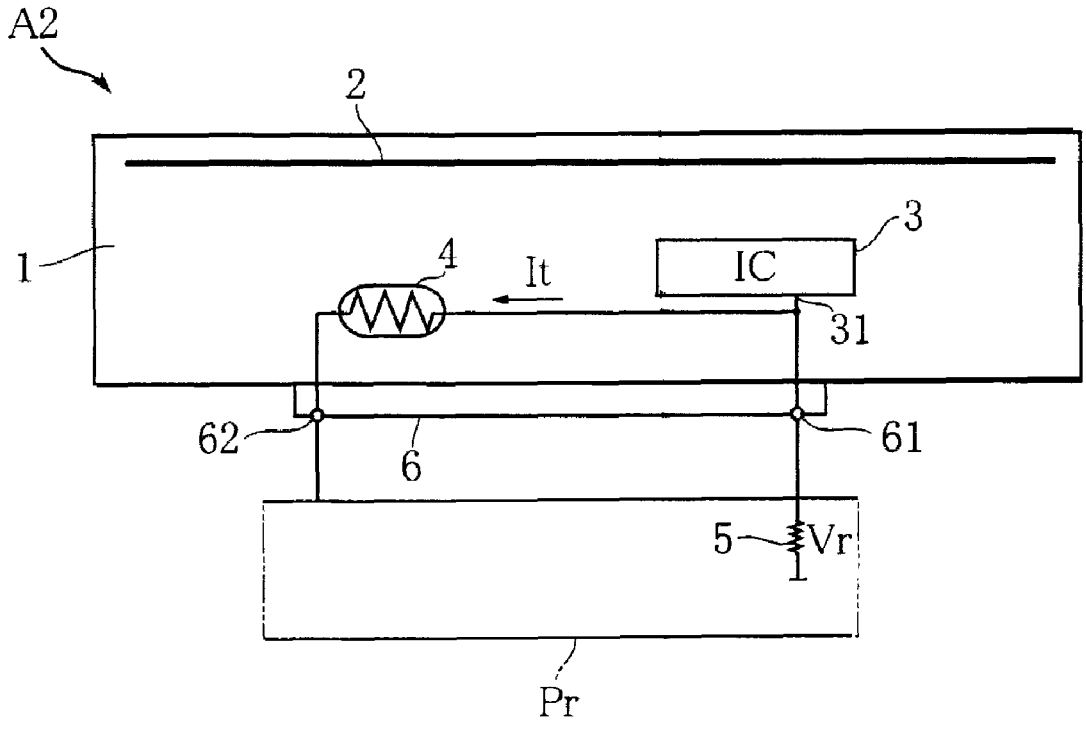
FIG. 2 illustrates a thermal printhead according to a second embodiment of the present invention.
Figure 3:
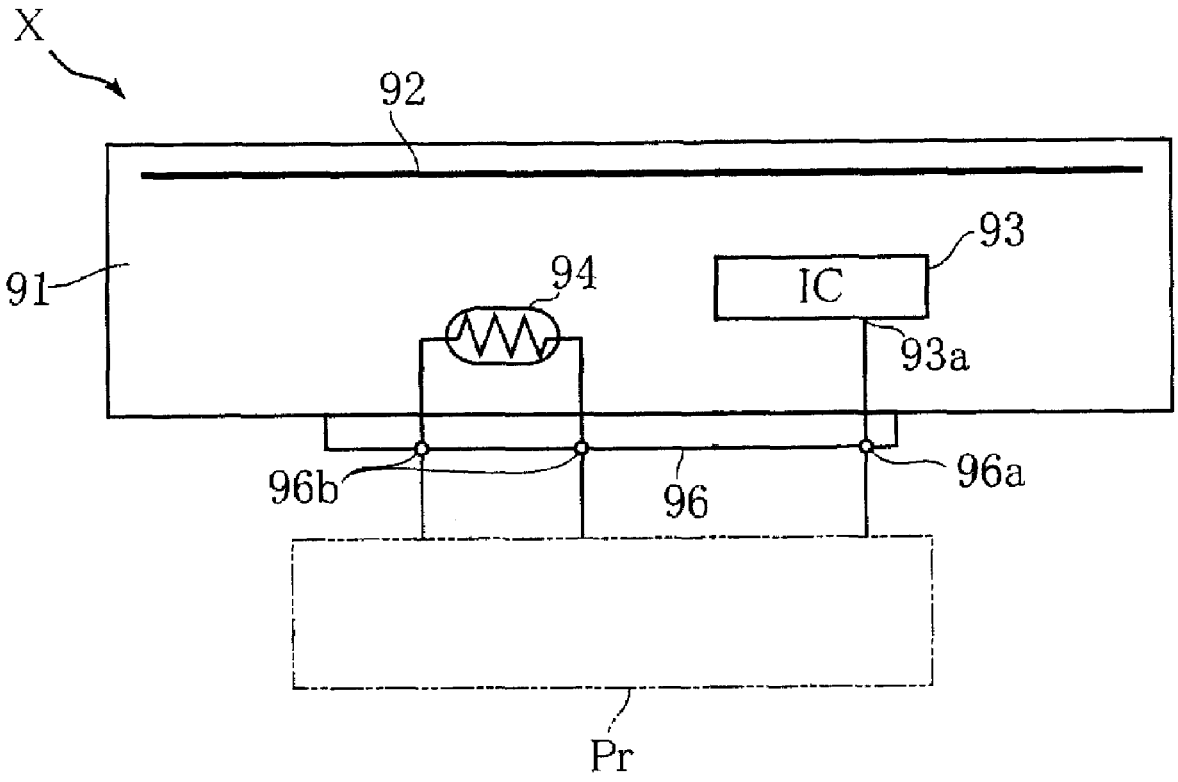
FIG. 3 PRIOR ART
FIG. 3 illustrates a conventional thermal printhead.

FIG. 2 shows a thermal printhead according to a second embodiment of the present invention. It should be noted here that in the figure, elements which are the same as or similar to those in the previous embodiment described above are indicated by the same references.

The second embodiment differs from the first embodiment in that the resistor 5 is provided not at the thermal printhead A2 but at the control section Pr. With such an embodiment, it is also possible to appropriately stop the printing operation when the substrate 1 comes to an abnormally high temperature condition. The resistor 5 may be provided elsewhere, other than in the control section Pr, at an appropriate place in the thermal printer.

The thermal printhead according to the present invention is not limited to these embodiments described thus far. Specific details of the thermal printhead according to the present invention may be varied in many ways.

The print execution signal terminal according to the present invention is not limited to a terminal where a strobe signal is applied. Use of any other terminal which receives a voltage whose High/Low status determines execution/stoppage of the printing operation will also accomplish the function intended in the present invention.

The invention claimed is:

1. A thermal printhead comprising:

a substrate;

a heating resistor formed on the substrate;

a drive IC for controlling power application to the heating resistor; and a thermistor mounted on the substrate and including a first terminal and a second terminal;

wherein the drive IC includes a print execution signal terminal for activation of the heating resistor upon application of a voltage higher than a threshold value, wherein the first terminal of the thermistor is connected with the print execution signal terminal.

2. The thermal printhead according to claim 1, further comprising: an external connection terminal connected with the print execution signal terminal; and a resistor including a first end and a second end; wherein the first end of the resistor is connected with the print execution signal terminal, the second end of the resistor being connected with the external connection terminal, the first terminal of the thermistor being connected with a connection path extending between the first end of the resistor and the print execution signal terminal.

3. The thermal printhead according to claim 1, wherein the second terminal of the thermistor is connected with a grounding line.

* * * * *